US008979712B2

(12) United States Patent
Lo et al.

(10) Patent No.: US 8,979,712 B2
(45) Date of Patent: Mar. 17, 2015

(54) LEG EXERCISER

(71) Applicants: Yuan-Hung Lo, Xinwu Township, Taoyuan County (TW); Chung-Chin Yang, Taoyuan, Taoyuan County (TW); Jun-Jui Hsu, Taichung (TW)

(72) Inventors: Yuan-Hung Lo, Xinwu Township, Taoyuan County (TW); Chung-Chin Yang, Taoyuan, Taoyuan County (TW); Jun-Jui Hsu, Taichung (TW)

(73) Assignees: Yuan-Hung Lo, Taoyuan County (TW); Chung-Chin Yang, Taoyuan County (TW); Jun-Jui Hsu, Taichung (TW)

( * ) Notice: Subject to any disclaimer, the term of this patent is extended or adjusted under 35 U.S.C. 154(b) by 81 days.

(21) Appl. No.: 13/656,732

(22) Filed: Oct. 21, 2012

(65) Prior Publication Data

US 2014/0113774 A1 Apr. 24, 2014

(51) Int. Cl.

| | |
|---|---|
| ***A63B 22/00*** | (2006.01) |
| ***A63B 71/00*** | (2006.01) |
| ***A63B 22/04*** | (2006.01) |
| ***A63B 69/18*** | (2006.01) |
| ***A63B 23/08*** | (2006.01) |

(52) U.S. Cl.

USPC ..... 482/52; 482/51; 482/70; 482/80

(58) Field of Classification Search

USPC ..... 482/51–52, 70–71, 79–80

See application file for complete search history.

(56) References Cited

U.S. PATENT DOCUMENTS

| | | | | |
|---|---|---|---|---|
| 5,230,676 | A * | 7/1993 | Terauds | 482/53 |
| 5,232,419 | A * | 8/1993 | Kozak | 482/52 |
| 5,348,520 | A * | 9/1994 | Chang | 482/52 |
| 6,135,927 | A * | 10/2000 | Lo | 482/57 |
| 6,796,928 | B1 * | 9/2004 | Christopher et al. | 482/51 |
| 7,621,850 | B2 * | 11/2009 | Piaget et al. | 482/54 |
| 8,246,522 | B2 * | 8/2012 | Piaget et al. | 482/53 |
| 8,277,366 | B2 * | 10/2012 | Savane | 482/52 |
| 2013/0231217 | A1 * | 9/2013 | Miller | 482/52 |
| 2014/0080676 | A1 * | 3/2014 | Wang | 482/52 |
| 2014/0080677 | A1 * | 3/2014 | Piaget et al. | 482/52 |

* cited by examiner

*Primary Examiner* — Loan H Thanh
*Assistant Examiner* — Megan Anderson

(57) ABSTRACT

A leg exerciser includes a base positioned on the floor, two pedals pivotally connected to the base in a parallel manner, two spring plates supporting the pedals on the floor, each spring plate having a fixed end connected to one pedal, a free end movably supported on the floor and a smoothly arched suspension arm connected between the fixed end and the free end, and two sliding coupling devices coupled between the free ends of the spring plates and the base, each sliding coupling device including a track plate extended from the base along a predetermined path and a roller pivotally connected to the free end of one spring plate and rotatably supported on the track plate.

15 Claims, 5 Drawing Sheets

LEG EXERCISER

BACKGROUND OF THE INVENTION

1. Field of the Invention

The present invention relates to physical exercising equipment and more particularly, to a leg exerciser for indoor application to exercise the muscles of the legs and to train the strength of the heart and lungs.

2. Description of the Related Art

Among commercial fitness, gym & exercise fitness equipment, the more popular ones are those designed for indoor application to simulate walking or running in exercising the muscles of the legs or training the strength of the heart and lungs. More particularly, the treadmill has been the most popular machine used for regular exercisers. Commercial treadmills commonly comprise a base seat, a tread platform consisting of a set of rollers, and a tread belt disposed on the tread platform and rotatable on the rollers. When a user is running on the tread belt at the tread platform, the tread belt is being continuously rotated in situ.

However, running on a treadmill puts much stress on your legs and knees. To avoid putting much stress on the knees, motor-based ladder exercises and stepper exercisers are developed. These motor-based exercisers commonly comprise two pedals connected to a motor system for enabling the user to simulate a ladder climbing or walking without putting significant stress on the knees. These motor-based exercisers are functional, however they commonly have a large size, not suitable for home use.

Taiwan Utility Model M414973 discloses a hydraulic stepping exerciser, which uses two hydraulic cylinders to support two pedals, enabling each pedal to be rapidly returned to its former position after having been stepped down. Further, people highly appreciate the characteristic of compact size of this design of hydraulic stepping exerciser. However, the lifespan of the hydraulic cylinders of this design of hydraulic stepping exerciser is not long. After a long use, the hydraulic cylinders of this design of hydraulic stepping exerciser may leak or break easily. An improvement in this regard is desired.

SUMMARY OF THE INVENTION

The present invention has been accomplished under the circumstances in view. It is the main object of the present invention to provide a leg exerciser, which has the characteristics of simple structure, ease of maintenance and storage and high durability that attract people to purchase.

To achieve this and other objects of a leg exerciser comprises a base positioned on a floor, two pedals arranged in parallel above the base, each pedal having one end thereof pivotally connected to the base, and two elastically deformable support members supporting the pedals on the floor, each said elastically deformable support member comprising a fixed end connected to one said pedal and a free end disposed in proximity to said floor. The elastically deformable support members are so configured that the free ends of the elastically deformable support members are alternatively moved back and forth along a predetermined path when a user is pedaling the pedals.

Further, the predetermined path is disposed in parallel to the floor.

Further, the elastically deformable support members are respectively formed of a respective spring plate, comprising a smoothly arched suspension arm connected between the fixed end and the free end.

Further, the free end of each elastically deformable support member has an elongated configuration and connected to the bottom wall of the associating pedal in a substantially parallel manner. Further, the spring plate of each elastically deformable support member defines a recessed surface portion on the bottom side of the smoothly arched suspension arm thereof and extending along the length of the smoothly arched suspension arm.

Further, two sliding coupling devices are respectively coupled between the free ends of the elastically support members and the base. Each sliding coupling device comprises a track plate extended from the base along the predetermined path, and a roller pivotally connected to the free end of one elastically support member and rotatably supported on the track plate.

Further, two elastic pull cords are respectively connected to the pedals.

In an alternate form of the present invention, the leg exerciser comprises a base positioned on the floor, two pedals arranged in parallel above the base, each pedal having one end thereof pivotally connected to the base, and two spring plates supporting the pedals on the floor. Each spring plate comprises a fixed end connected to one pedal, a free end movably supported on the floor, and a smoothly arched suspension arm connected between the fixed end and the free end.

Further, according to this alternate form, the free end of each spring plate has an elongated configuration and is connected to the bottom wall of the associating the pedal in a substantially parallel manner. Further, each spring plate defines a recessed surface portion on the bottom side of the smoothly arched suspension arm thereof and extending along the length of the smoothly arched suspension arm.

Further, according to this alternate form, two sliding coupling devices are respectively coupled to the free ends of the spring plates and alternatively movable back and forth along a predetermined path.

Further, according to this alternate form, the predetermined path is disposed in parallel to the floor.

Further, according to this alternate form, each sliding coupling device comprises a track plate extended from the base along the predetermined path, and a roller pivotally connected to the free end of one spring plate and rotatably supported on the track plate.

Further, according to this alternate form, two elastic pull cords are respectively connected to the pedals.

In conclusion, the invention uses spring plates to support the pedals on the floor and to impart a feedback force and an elastic restoring force to the pedals when the user is stepping on the pedals, maintaining structural simplicity for easy maintenance. Further, subject to the arrangement of the track plate and roller of the sliding coupling device at the free end of each spring plate, the invention enhances the operational smoothness and stability.

DETAILED DESCRIPTION OF THE PREFERRED EMBODIMENT

Figure 1:
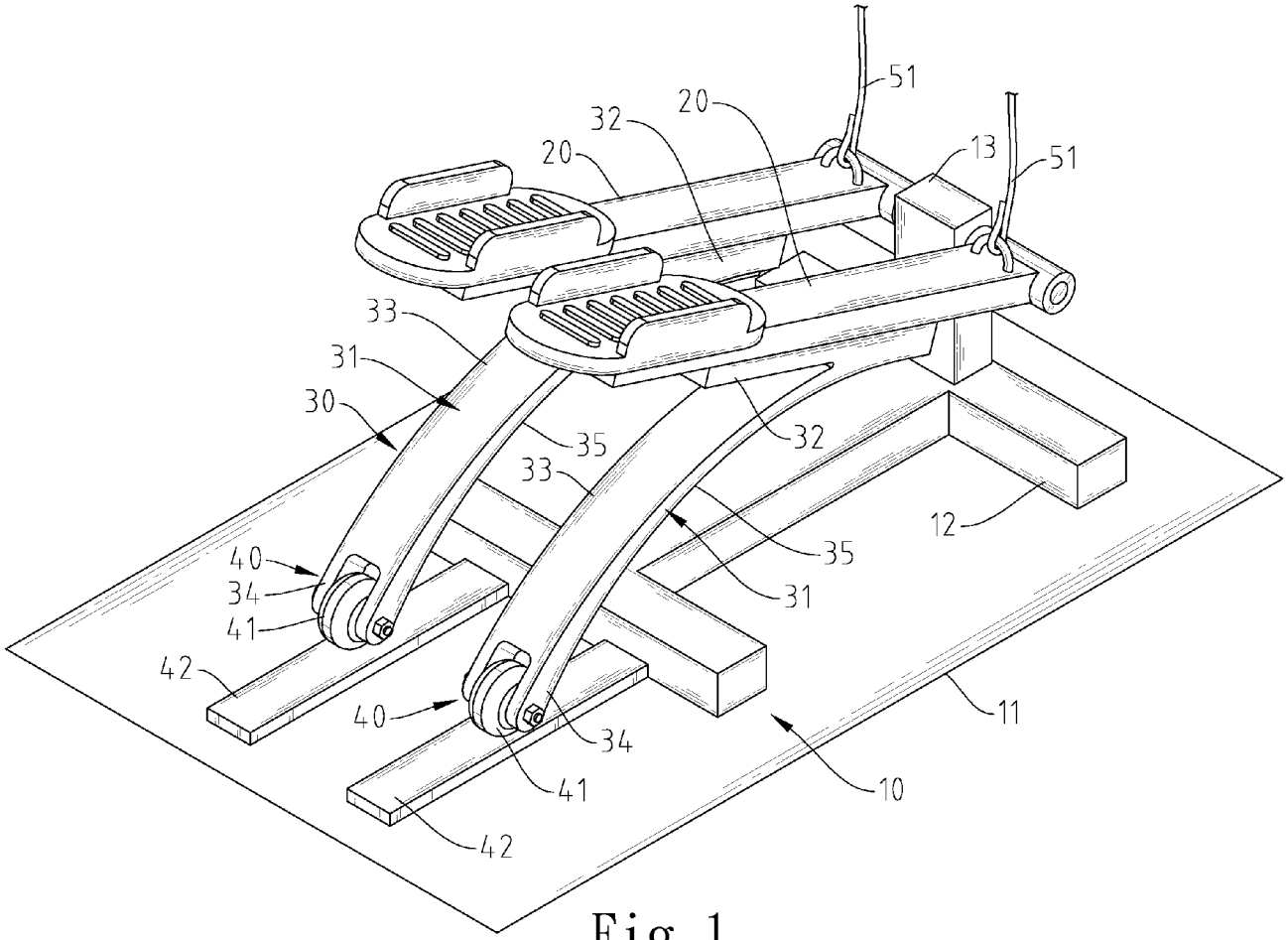
FIG. 1 is an elevational view of a leg exerciser in accordance with the present invention.
Figure 2:
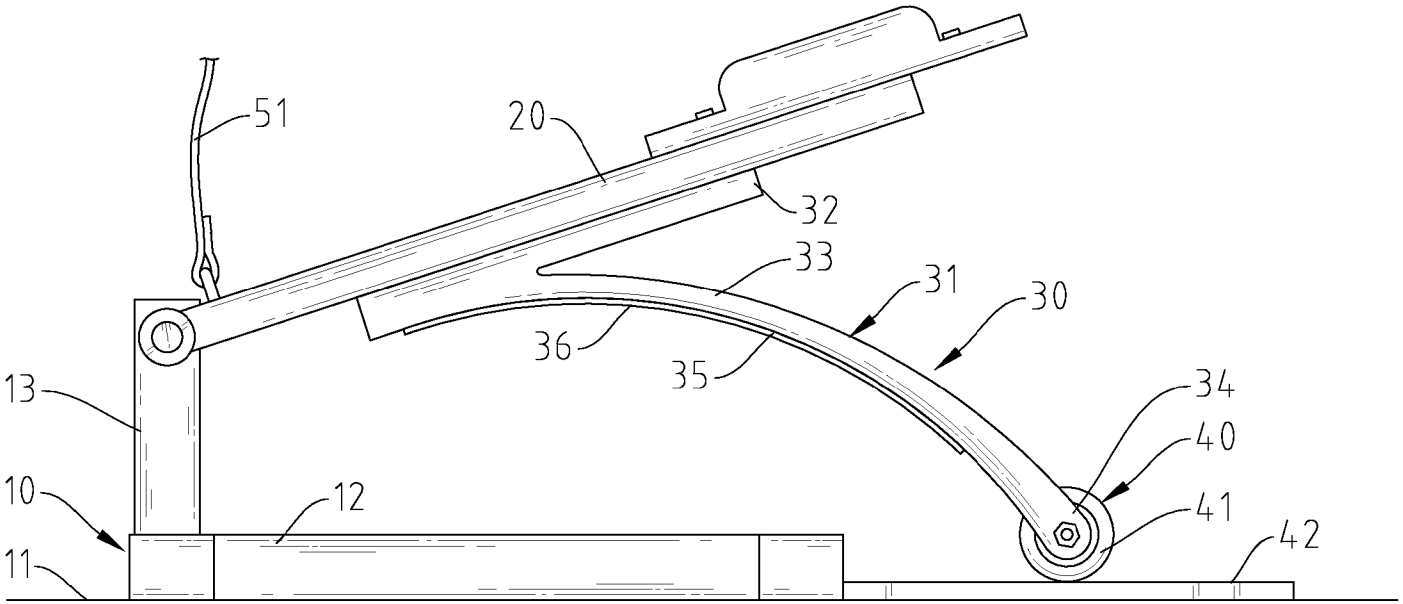
FIG. 2 is a side view of the leg exerciser in accordance with the present invention.

Referring to FIGS. 1 and 2, a leg exerciser in accordance with the present invention is shown comprising a base 10 positioned on the floor 11, two pedals 20 pivotally provided at the top side of the base 10, and two elastically deformable support members 30 supporting the pedals 20 on the floor 11.

The base 10 comprises an H-frame 12 horizontally positioned on the floor 11, and an upright support 13 vertically upwardly extended from one end of the H-frame 12. The two pedals 20 are supported on the elastically deformable support members 30 above the base 10, each having one end thereof respectively pivoted to the upright support 13.

The elastically support members 30 are respectively made of a spring plate 31. The spring plate 31 comprises an elongated fixed end 32 affixed to the bottom wall of one pedal 20 in a substantially parallel manner to enhance connection stability, a free end 34 disposed in proximity to the floor 11 and movable back and forth along a predetermined path 50 in parallel to the floor 11, an smoothly arched suspension arm 33 connected between the elongated fixed end 32 and the free end 32, and a recessed surface portion 35 located on the bottom side of the smoothly arched suspension arm 33 and extending along the length of the smoothly arched suspension arm 33.

Further, in order to enhance the mechanical strength and elastic restoring force of the smoothly arched suspension arm 33 of the spring plate 31 of each elastically support member 30, an elastic reed 36 configured subject to the configuration of the smoothly arched suspension arm 33 is attached to the bottom wall of the smoothly arched suspension arm 33.

When the user steps on the pedal 20, the spring plate 31 of the associating elastically support member 30 is elastically deformed to extend the linear distance between the fixed end 32 and the free end 34. When the applied force disappears, the spring plate 31 immediately returns to its former shape to shorten the linear distance between the fixed end 32 and the free end 34. Thus, when the user is alternatively stepping on the pedals 20, the elastically support members 30 are alternatively curved to move the pedals 20 up and down, and the free ends 34 of the spring plates 31 of the elastically support members 30 are alternatively moved back and forth along the predetermined path 50.

Figure 3:
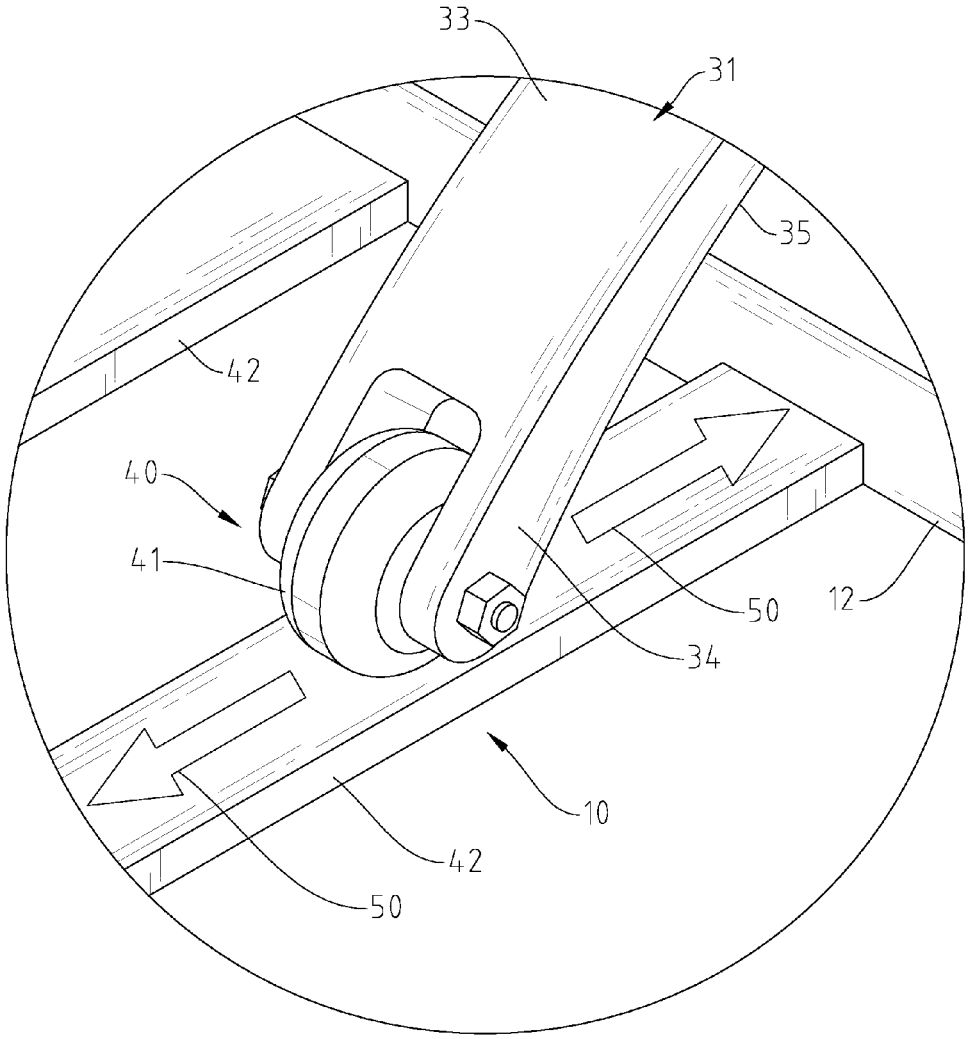
FIG. 3 is an enlarged view of a part of the present invention, illustrating the arrangement of the transmission mechanism.

Further, a sliding coupling device 40 is coupled between the free end 34 of the spring plate 31 of each elastically support member 30 and the base 10 to smoothen reciprocating movement of the free end 34 of the spring plate 31 of the associating elastically support member 30. As illustrated in FIG. 3, the sliding coupling device 40 comprises a track plate 42 extended from the other end of the H-frame 12 of the base 10 along the predetermined path 50 remote from the upright support 13 and kept in flush with the bottom wall of the H-frame 12 of the base 10, and a roller 41 pivotally connected to the free end 34 of the spring plate 31 of the associating elastically support member 30 and rotatably supported on the track plate 42. During reciprocating motion of the free end 34 of the spring plate 31 of each elastically support member 30 on the predetermined path 50, the roller 41 of the associating sliding coupling device 40 is forced to move back and forth along the track plate 42, reducing friction resistance between the free end 34 and the floor 11 and enhancing operational stability.

Figure 4:
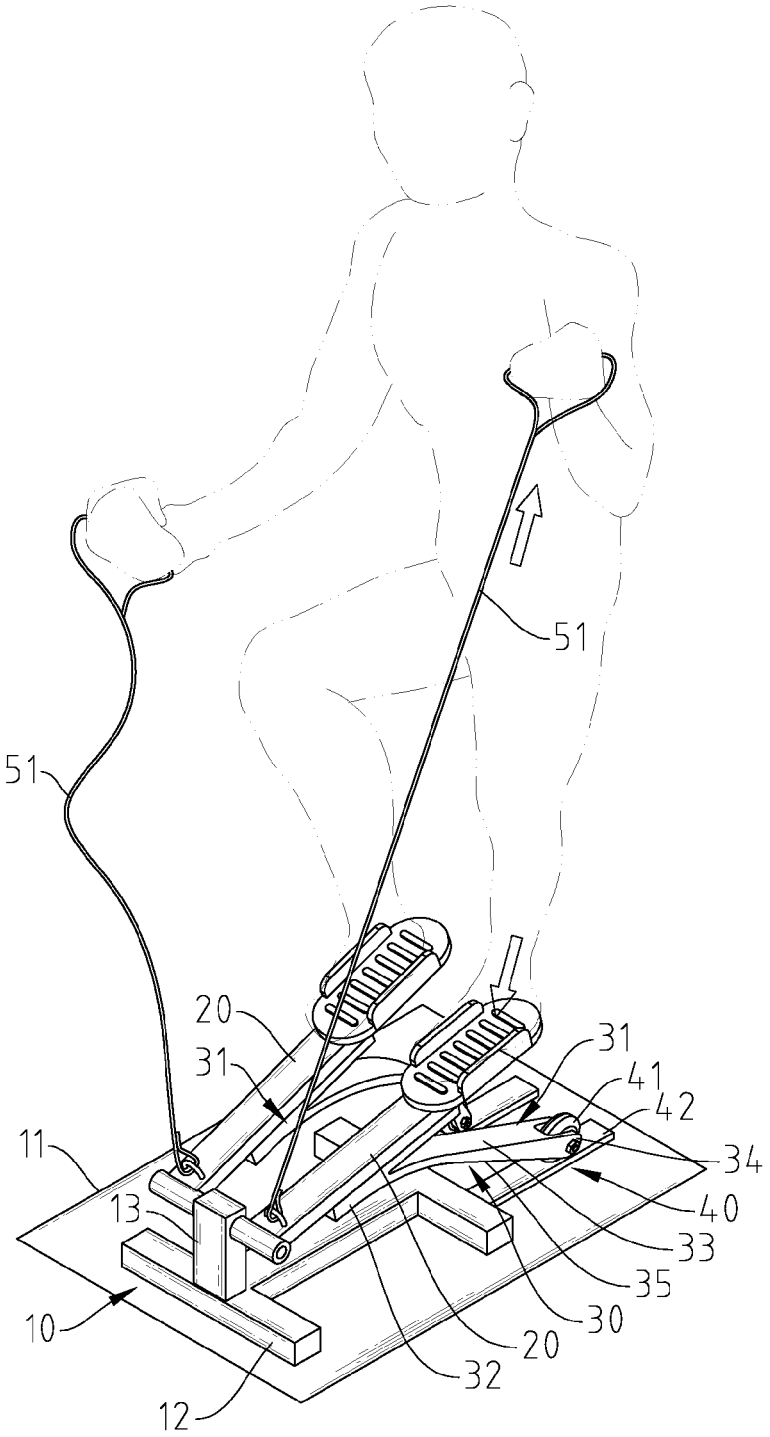
FIG. 4 is a schematic applied view of the present invention, illustrating an operation status of the leg exercise.
Figure 5:
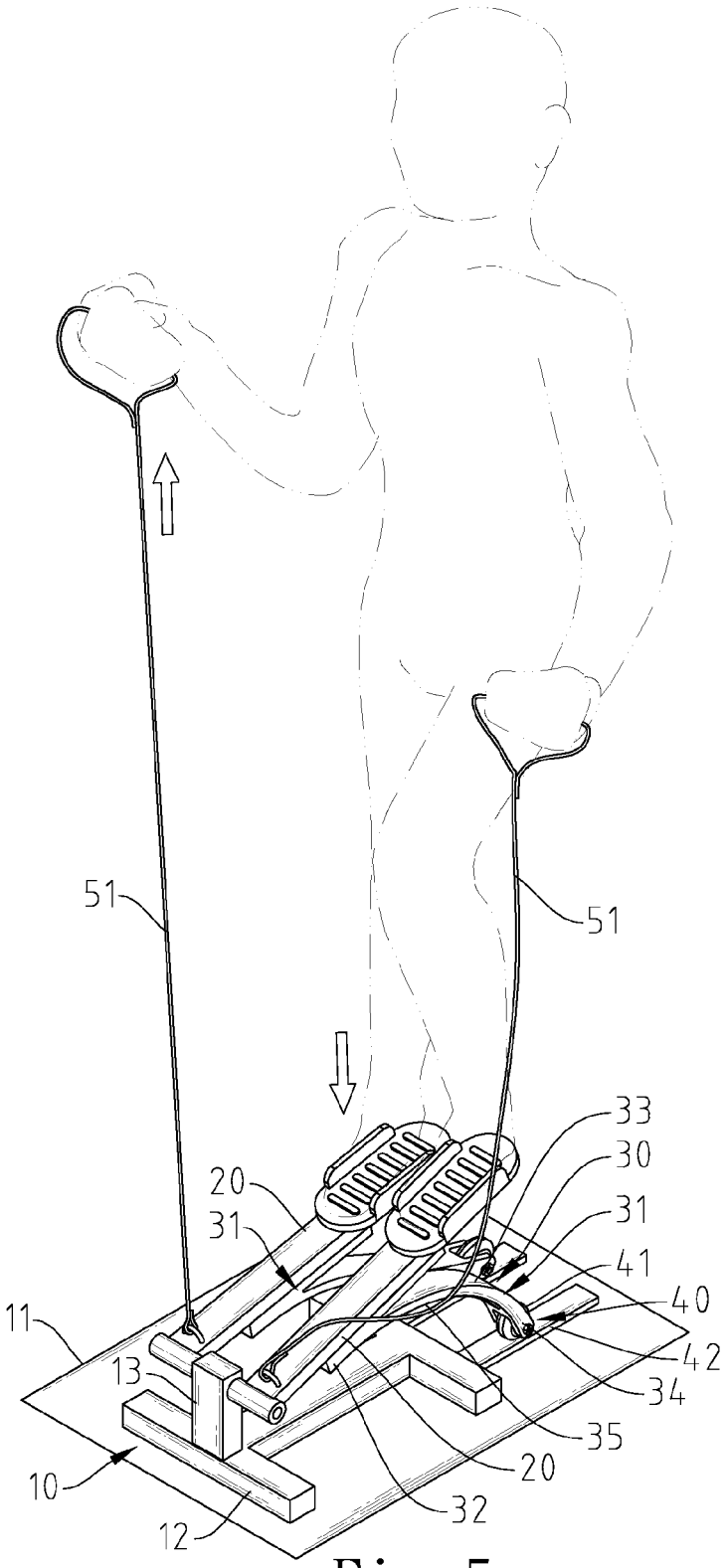
FIG. 5 is a schematic applied view of the present invention, illustrating another operation status of the leg exercise.

Referring to FIGS. 4 and 5, two elastic pull cords 51 are respectively connected to the pedals 20 adjacent to the upright support 13. When the user is stepping on the pedals 20, the user's both hands can seize and pull the elastic pull cords 51 to apply a resisting force to the pedals 20, thereby increasing the training intensity without adjusting the strength and weight of the spring plates 31 of the elastically support members 30.

As stated above, the invention uses the spring plates of the elastically support members to impart a feedback force and an elastic restoring force to the pedals when the user is stepping on the pedals, maintaining structural simplicity for easy maintenance. Further, subject to the arrangement of the track plate and roller of the sliding coupling device at the free end of the spring plate of each elastically support member, the invention enhances the operational smoothness and stability.

What the invention claimed is:

1. A leg exerciser, comprising:

a base positioned on a floor;

two pedals arranged in parallel above said base, each said pedal having one end thereof pivotally connected to said base; and two elastically deformable support members supporting said pedals on said floor, each said elastically deformable support member comprising a fixed end connected to one said pedal and a free end disposed in proximity to said floor, said elastically deformable support members being so configured that the free ends of said elastically deformable support members are alternatively moved back and forth along a predetermined path when a user is pedaling said pedals;

wherein said predetermined path is disposed in parallel to said floor.

2. The leg exerciser as claimed in claim 1, wherein said elastically deformable support members are respectively formed of a respective spring plate, comprising a smoothly arched suspension arm connected between said fixed end and said free end.

3. The leg exerciser as claimed in claim 2, wherein the free end of each said elastically deformable support member has an elongated configuration and connected to a bottom wall of the associating said pedal in a substantially parallel manner; the spring plate of each said elastically deformable support member defines a recessed surface portion on a bottom side of the smoothly arched suspension arm thereof and extending along the length of the smoothly arched suspension arm.

4. The leg exerciser as claimed in claim 1, further comprising two sliding coupling devices respectively coupled between the free ends of said elastically deformable support members and said base, each said sliding coupling device comprising a track plate extended from said base along said predetermined path, and a roller pivotally connected to the free end of one said elastically support member and rotatably supported on said track plate.

5. The leg exerciser as claimed in claim 1, further comprising two elastic pull cords respectively connected to said pedals.

6. A leg exerciser, comprising:

a base positioned on a floor;

two pedals arranged in parallel above said base, each said pedal having one end thereof pivotally connected to said base; and two elastically deformable support members supporting said pedals on said floor, each said elastically deformable support member comprising a fixed end connected to one said pedal and a free end disposed in proximity to said floor, said elastically deformable support members being so configured that the free ends of said elastically deformable support members are alternatively moved back and forth along a predetermined path when a user is pedaling said pedals;

wherein said elastically deformable support members are respectively formed of a respective spring plate, comprising a smoothly arched suspension arm connected between said fixed end and said free end.

7. The leg exerciser as claimed in claim 6, wherein the free end of each said elastically deformable support member has an elongated configuration and connected to a bottom wall of the associating said pedal in a substantially parallel manner; the spring plate of each said elastically deformable support member defines a recessed surface portion on a bottom side of the smoothly arched suspension arm thereof and extending along the length of the smoothly arched suspension arm.

8. The leg exerciser as claimed in claim 6, further comprising two sliding coupling devices respectively coupled between the free ends of said elastically deformable support members and said base, each said sliding coupling device comprising a track plate extended from said base along said predetermined path, and a roller pivotally connected to the free end of one said elastically support member and rotatably supported on said track plate.

9. The leg exerciser as claimed in claim 6, further comprising two elastic pull cords respectively connected to said pedals.

10. The leg exerciser as claimed in claim 6, wherein said predetermined path is disposed in parallel to said floor.

11. A leg exerciser, comprising:

a base positioned on a floor;

two pedals arranged in parallel above said base, each said pedal having one end thereof pivotally connected to said base; and two spring plates supporting said pedals on said floor, each said spring plate comprising a fixed end connected to one said pedal, a free end movably supported on said floor, and a smoothly arched suspension arm connected between said fixed end and said free end;

wherein the free end of each said spring plate has an elongated configuration and is connected to a bottom wall of the associating said pedal in a substantially parallel manner; each said spring plate defines a recessed surface portion on a bottom side of said smoothly arched suspension arm and extending along the length of said smoothly arched suspension arm.

12. The leg exerciser as claimed in claim 11, further comprising two sliding coupling devices respectively coupled to the free ends of said spring plates and alternatively movable back and forth along a predetermined path.

13. The leg exerciser as claimed in claim 12, wherein said predetermined path is disposed in parallel to said floor.

14. The leg exerciser as claimed in claim 12, wherein each said sliding coupling device comprises a track plate extended from said base along said predetermined path, and a roller pivotally connected to the free end of one said spring plate and rotatably supported on said track plate.

15. The leg exerciser as claimed in claim 11, further comprising two elastic pull cords respectively connected to said pedals.

* * * * *